US011548134B2

(12) United States Patent
McDonnell

(10) Patent No.: US 11,548,134 B2
(45) Date of Patent: Jan. 10, 2023

(54) MULTI-PIECE DETACHABLE MOP BODY

(71) Applicant: For Life Products, LLC, Miramar, FL (US)

(72) Inventor: Joseph A. McDonnell, Weston, FL (US)

(73) Assignee: For Life Products, LLC, Earth City, MO (US)

( * ) Notice: Subject to any disclaimer, the term of this patent is extended or adjusted under 35 U.S.C. 154(b) by 341 days.

(21) Appl. No.: 16/660,216

(22) Filed: Oct. 22, 2019

(65) Prior Publication Data

US 2020/0122312 A1 Apr. 23, 2020

Related U.S. Application Data

(60) Provisional application No. 62/748,896, filed on Oct. 22, 2018.

(51) Int. Cl.

| | |
|---|---|
| ***B25G 1/04*** | (2006.01) |
| ***A47L 13/20*** | (2006.01) |
| ***A47L 13/22*** | (2006.01) |
| *B25G 3/38* | (2006.01) |

(52) U.S. Cl.
CPC ..... *B25G 1/04* (2013.01); *A47L 13/20* (2013.01); *A47L 13/22* (2013.01); *B25G 3/38* (2013.01)

(58) Field of Classification Search
CPC ..... A47L 13/20; A47L 13/22; B25G 1/04
USPC ..... 15/144.3–144.4
See application file for complete search history.

(56) References Cited

U.S. PATENT DOCUMENTS

| | | | | |
|---|---|---|---|---|
| 6,311,368 | B1 * | 11/2001 | Sartori | B25G 1/04 15/144.3 |
| 8,579,537 | B2 * | 11/2013 | VanLandingham | B25G 1/04 16/427 |
| 9,969,074 | B2 * | 5/2018 | Flaherty | B25G 1/01 |
| 2007/0089255 | A1 * | 4/2007 | Michelson | A47L 13/20 15/144.3 |

* cited by examiner

*Primary Examiner* — Laura C Guidotti
(74) *Attorney, Agent, or Firm* — Merchant & Gould P.C.

(57) ABSTRACT

A multi-piece detachable mop body is disclosed herein. Among other features, the multi-piece detachable mop body comprises a plurality of pole sections configured to couple with one another to form an integral elongated body during use and disengage with one another into the plurality of pole sections for transportation, packaging and storage purposes.

6 Claims, 16 Drawing Sheets

MULTI-PIECE DETACHABLE MOP BODY

FIELD OF TECHNOLOGY

The present disclosure generally relates to a mop body having multiple detachable pieces.

BACKGROUND

Mops have been used to clean various floor surfaces for many years. However, the elongated body of a mop may present difficulties and inconvenience for transportation, packaging and storage.

Accordingly, there is a need for a mop having multiple detachable pieces that may be assembled quickly and easily for use and disassembled into multiple pieces for easy transportation, packaging and storage.

SUMMARY

The present disclosure discloses a multi-piece detachable mop body, comprising: a plurality of pole sections configured to couple with one another to form an integral elongated body during use and disengage with one another into the plurality of pole sections for transportation, packaging and storage purposes.

The above simplified summary of example aspects serves to provide a basic understanding of the present disclosure. This summary is not an extensive overview of all contemplated aspects, and is intended to neither identify key or critical elements of all aspects nor delineate the scope of any or all aspects of the present disclosure. Its sole purpose is to present one or more aspects in a simplified form as a prelude to the more detailed description of the disclosure that follows. To the accomplishment of the foregoing, the one or more aspects of the present disclosure include the features described and exemplary pointed out in the claims.

BRIEF DESCRIPTION OF THE DRAWINGS

The accompanying drawings, which are incorporated into and constitute a part of this specification, illustrate one or more example aspects of the present disclosure and, together with the detailed description, serve to explain their principles and implementations.

DETAILED DESCRIPTION

Figure 1:
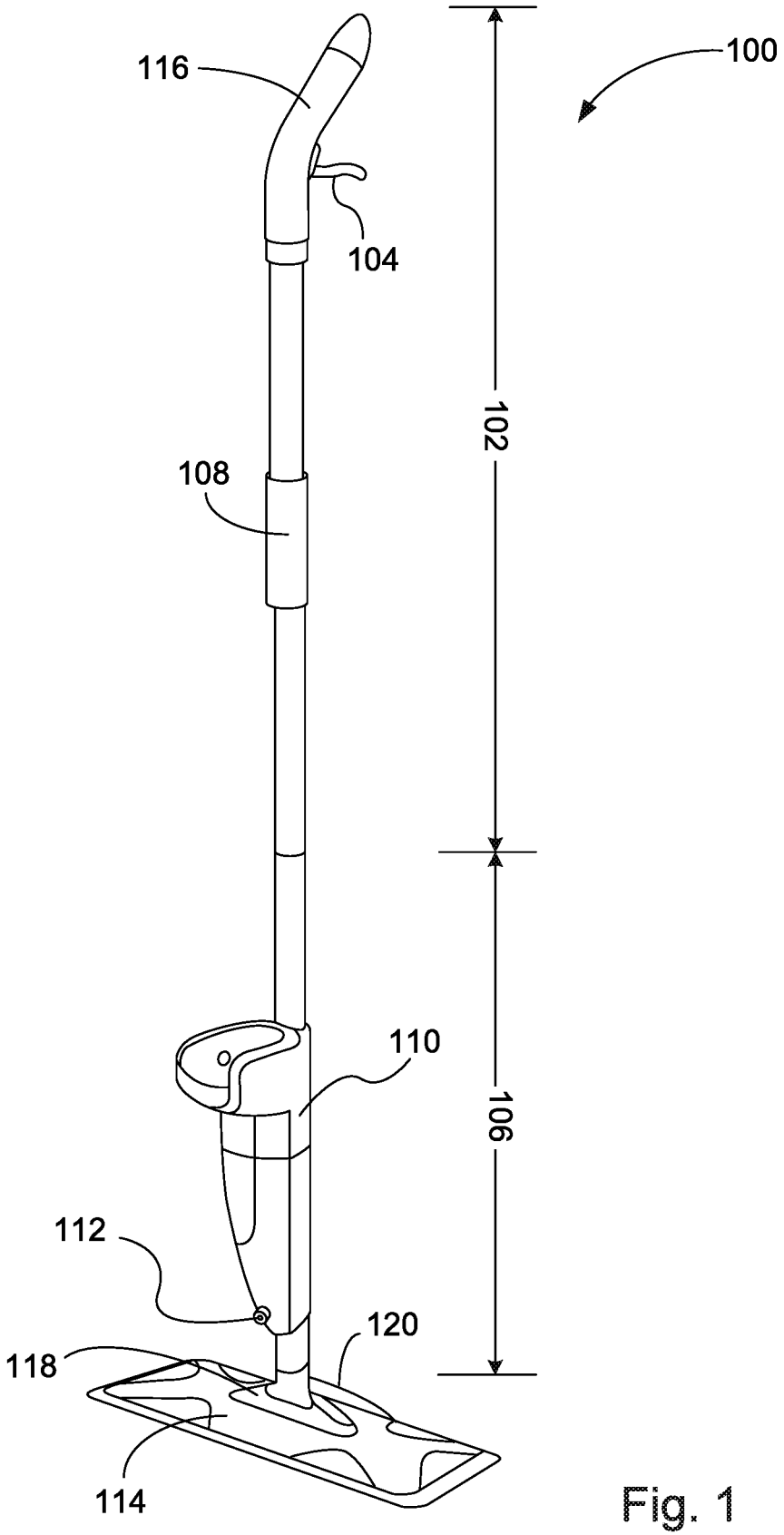
FIG. 1 illustrates a multi-surface spray mop comprising an elongated body having two pole sections.

Various aspects of the disclosure will be described with reference to the drawings, wherein like reference numerals are used to refer to like elements throughout. In the following description, for purposes of explanation, numerous specific details are set forth in order to promote a thorough understanding of one or more aspects of the disclosure. It may be evident in some or all instances, however, that any aspects described below can be practiced without adopting the specific design details described below.

Figure 2:
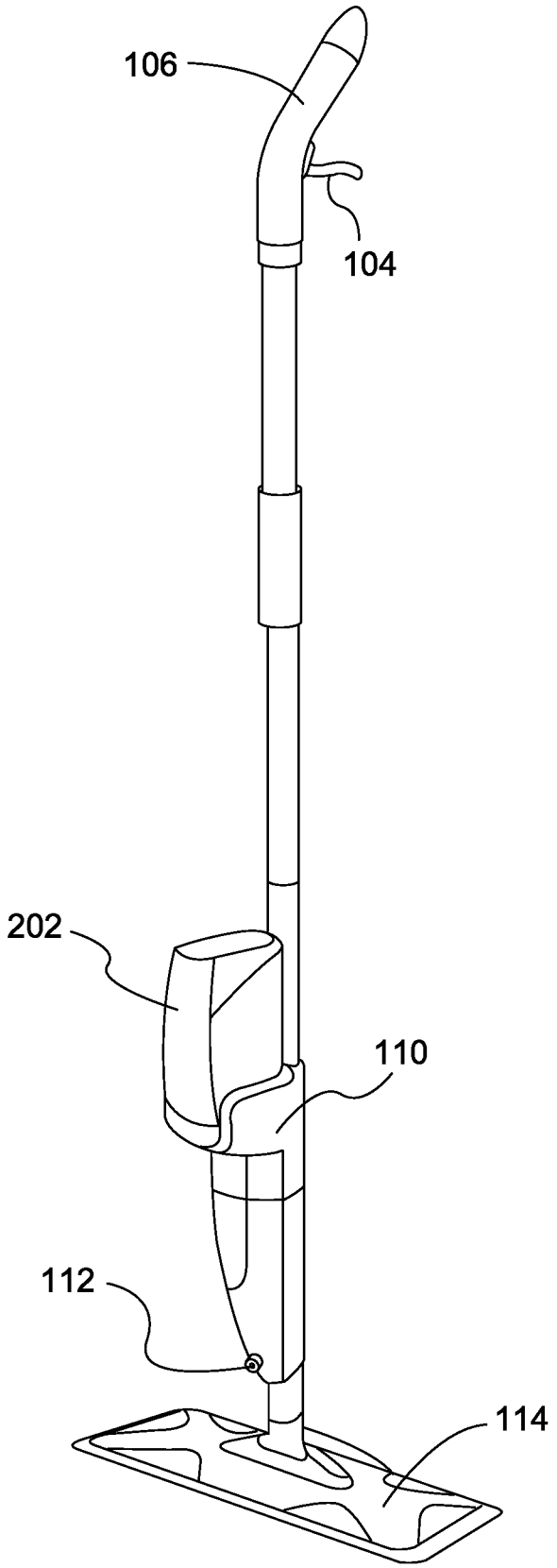
FIG. 2 illustrates a multi-surface spray mop with a cleaning liquid bottle inserted into a bottle reservoir of the multi-surface spray mop.
Figure 3:
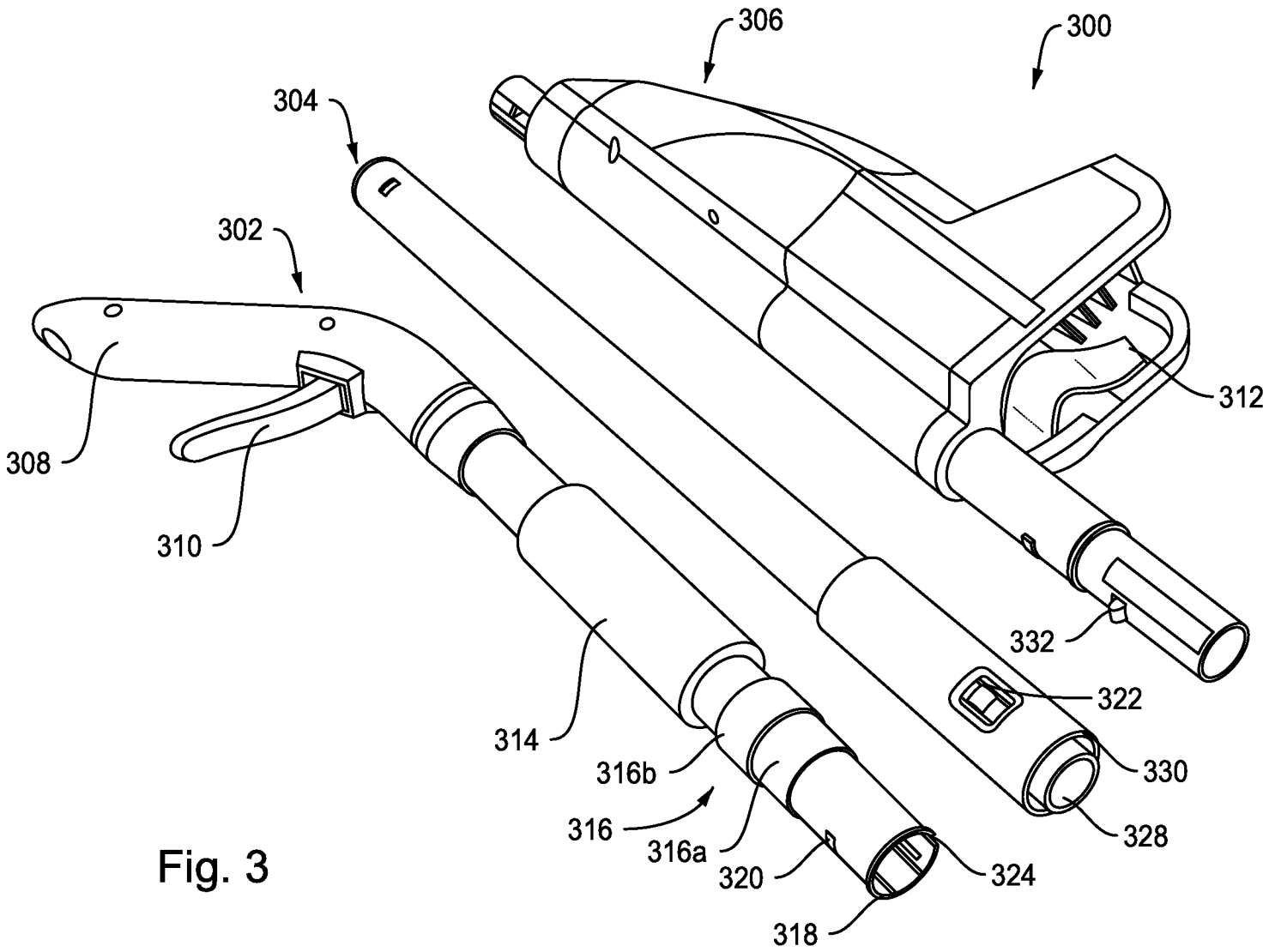
FIG. 3 illustrates a multi-piece detachable mop body (an example 3-piece configuration), according to an exemplary aspect.

Referring to FIGS. 1-3, a multi-surface spray mop 100 may include an elongated mop body having a plurality of pole sections. For example, as shown in FIG. 1, a two-pole spray mop 100 may include an upper pole section 102, a spray trigger 104, a lower pole section 106, a soft support grip portion 108 positioned on the shaft of the upper pole section 102, a bottle reservoir 110 with a directional mist nozzle 112 on its front surface, and a mop base 114. However, each of the upper and lower pole sections 102 and 104 of mop 100 may still have a length that may be inconvenient for transportation, packaging and storage. In accordance with aspects of the present disclosure, as shown in FIG. 3, a multi-piece detachable mop body 300 may include at least three pole sections that may be assembled and disassembled with one another by a user. In one embodiment, a three-pole spray mop may include an upper pole section 302, a middle connecting pole section 304, and a lower pole section 306.

Such spray mop 100 may be used for dusting, scrubbing and cleaning various surfaces such as hardwood, laminate, vinyl, granite, stone, marble, tile floors, and carpet. As will be described fully below, the plurality of pole sections of spray mop 100 and the mop base 114 may be readily assembled together to form a mop having an integral elongated body and dissembled into separate pieces for easy storage. As shown in FIGS. 1 and 2, an angled ergonomic mop handle 116 may be provided at one distal end of the upper pole section 102 for a user to guide the spray mop 100 in a desired direction with reduced hand and wrist strain. The soft support grip portion 108 positioned on the shaft of the upper pole section 102 may provide a secondary handhold. The lower pole section 106 may comprise a first distal end for connecting with the upper pole section 102, and a second distal end having a protruding coupling portion for connecting with the mop base 114 or a brush. The mop base 114 includes a swivel joint 118 that allows a user to use the handle of the mop 100 to move back and forth along a desired path.

In one aspect, the bottle reservoir 110 on the lower pole section 106 may receive and retain a cleaning liquid bottle 202, as shown in FIG. 2, when the spray mop 100 is in use. The nozzle 112 may be generally directed forward and downward so that cleaning liquid drawn out of the bottle 202 and exiting the nozzle 112 is sprayed onto a surface in front of the mop 100. For example, depending upon the type of the flooring surface (e.g., marble, hardwood, or tile), a compatible bottled cleaning liquid may be selected and a bottle adapter may replace either the original bottle cap or a trigger sprayer of the cleaning product before it is inserted into the bottle reservoir 110.

Figure 4:
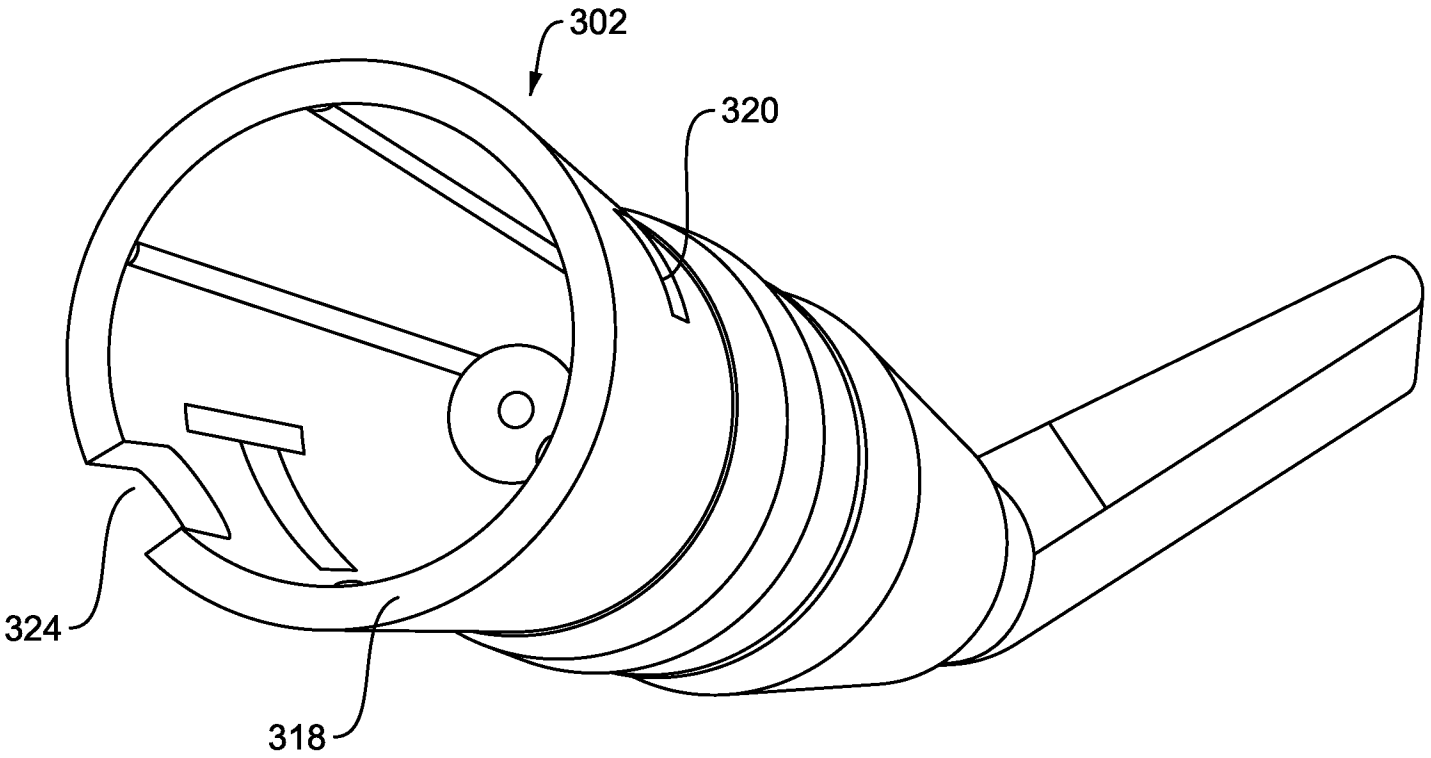
FIGS. 4-6 illustrate various end perspective views of a first pole section of the multi-piece detachable mop body, according to an exemplary aspect.
Figure 6:
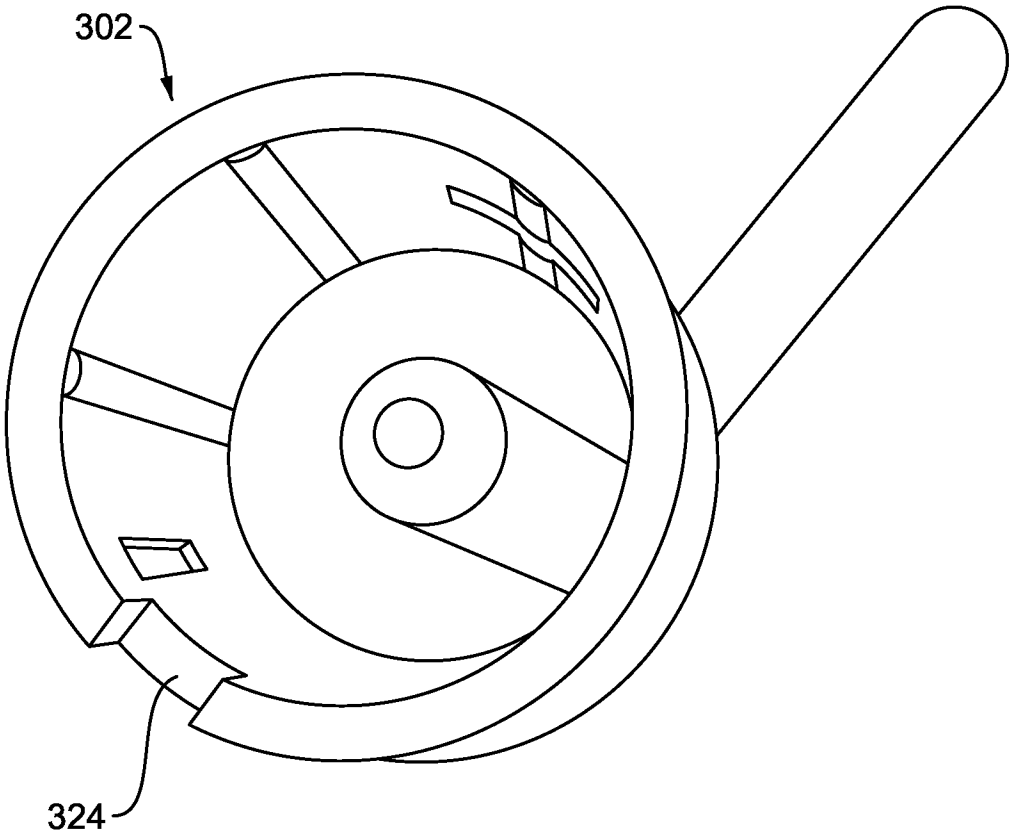
Figure 7:
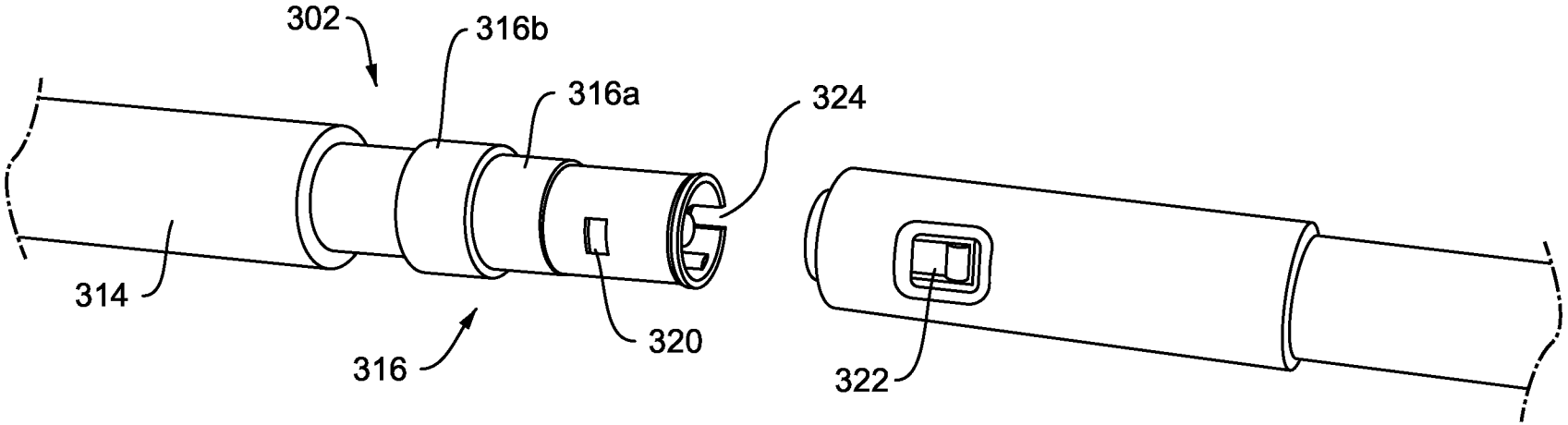
FIGS. 7-9 illustrate various views of connecting portions of two pole sections of the multi-piece detachable mop body prior to coupling of the two pole sections, according to an exemplary aspect.
Figure 8:
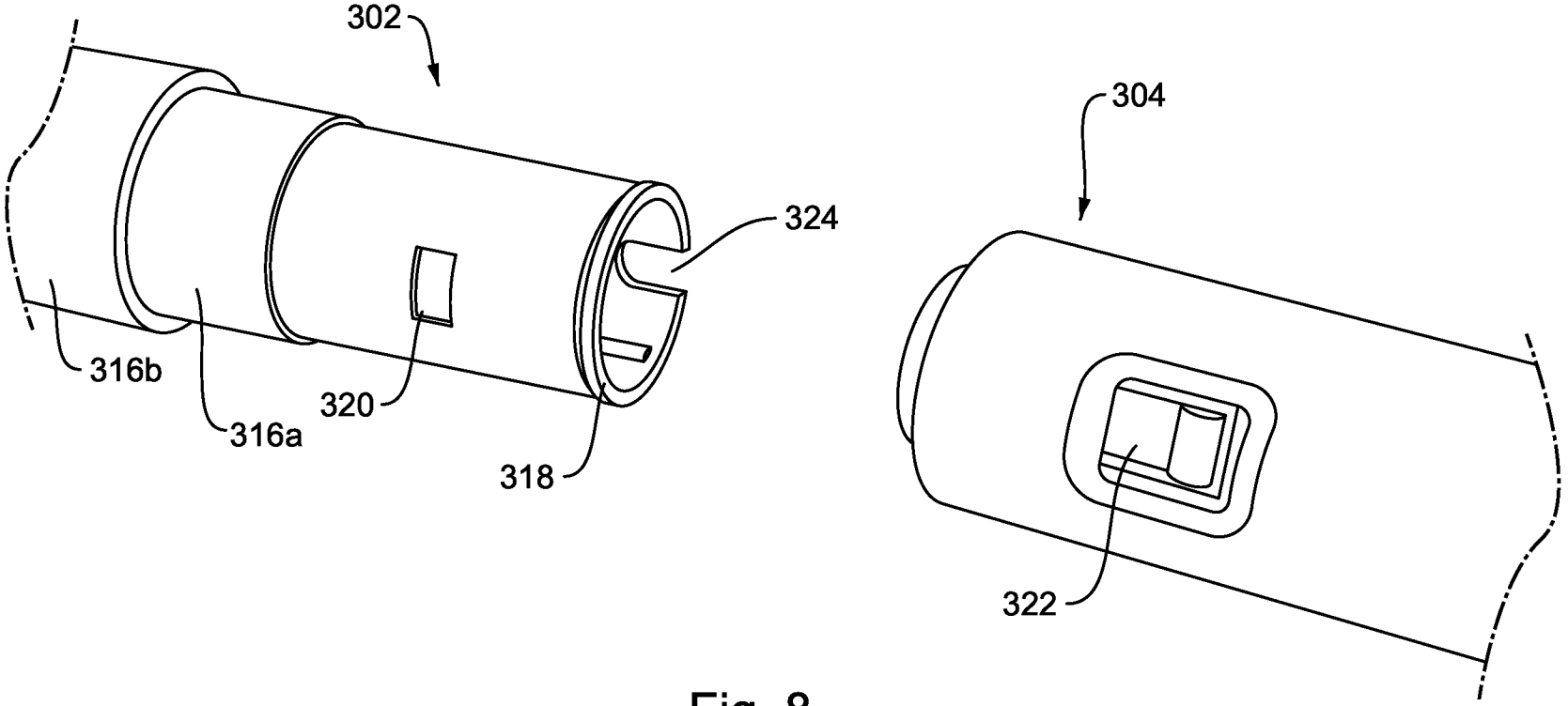
Figure 9:
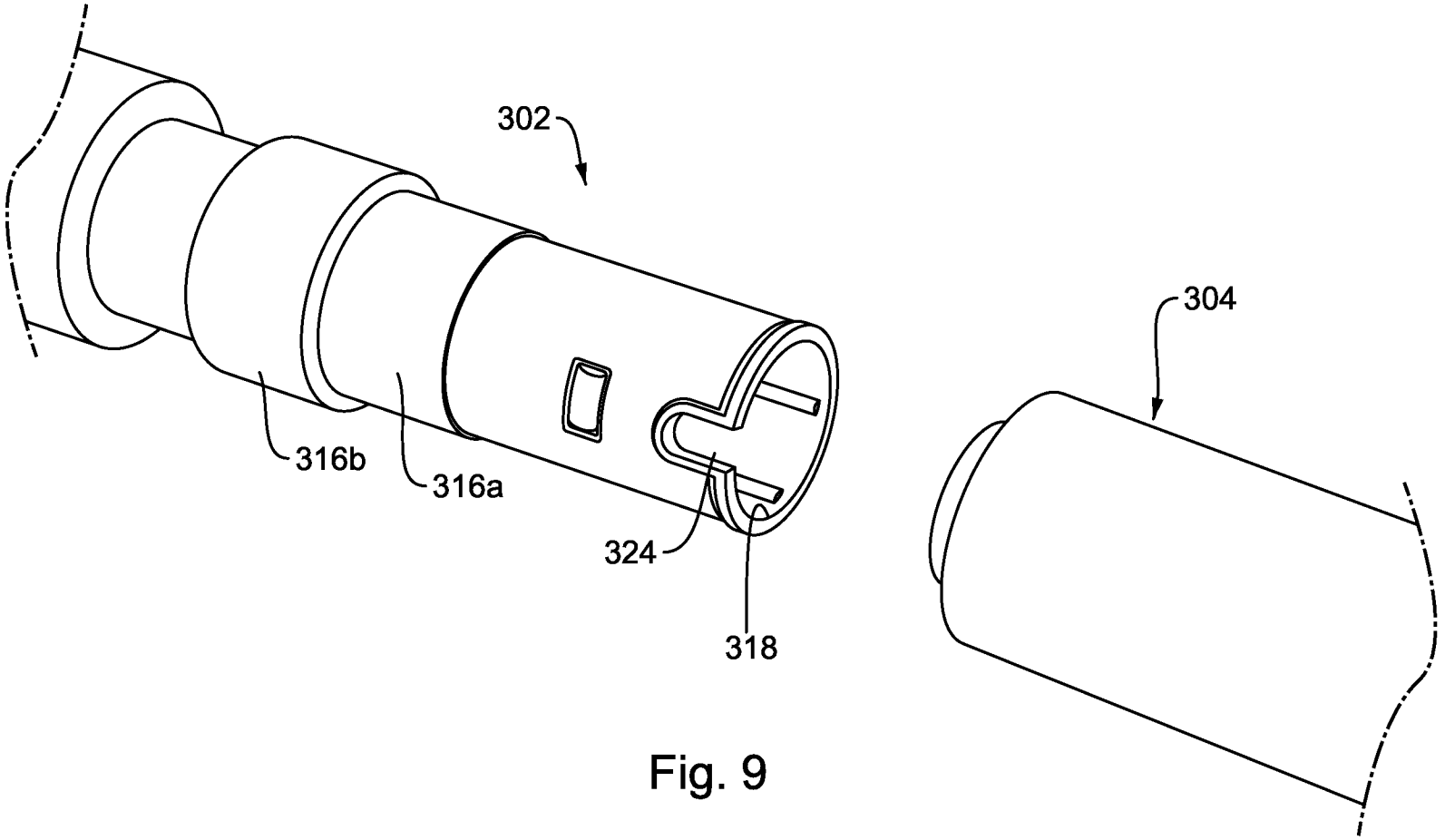
Figure 10:
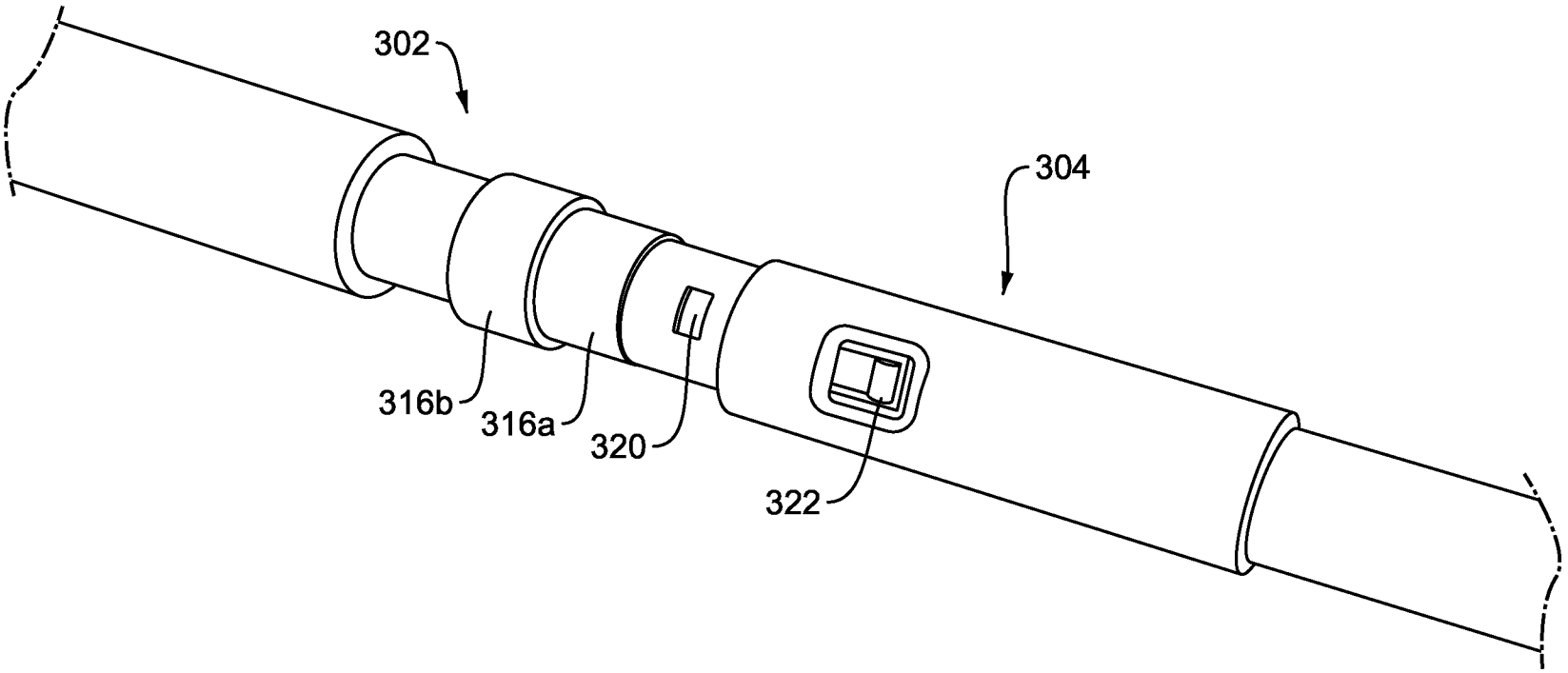
FIGS. 10-13 illustrate various views of connecting portions of two pole sections of the multi-piece detachable mop body when the two pole sections are coupled with each other, according to an exemplary aspect.
Figure 11:
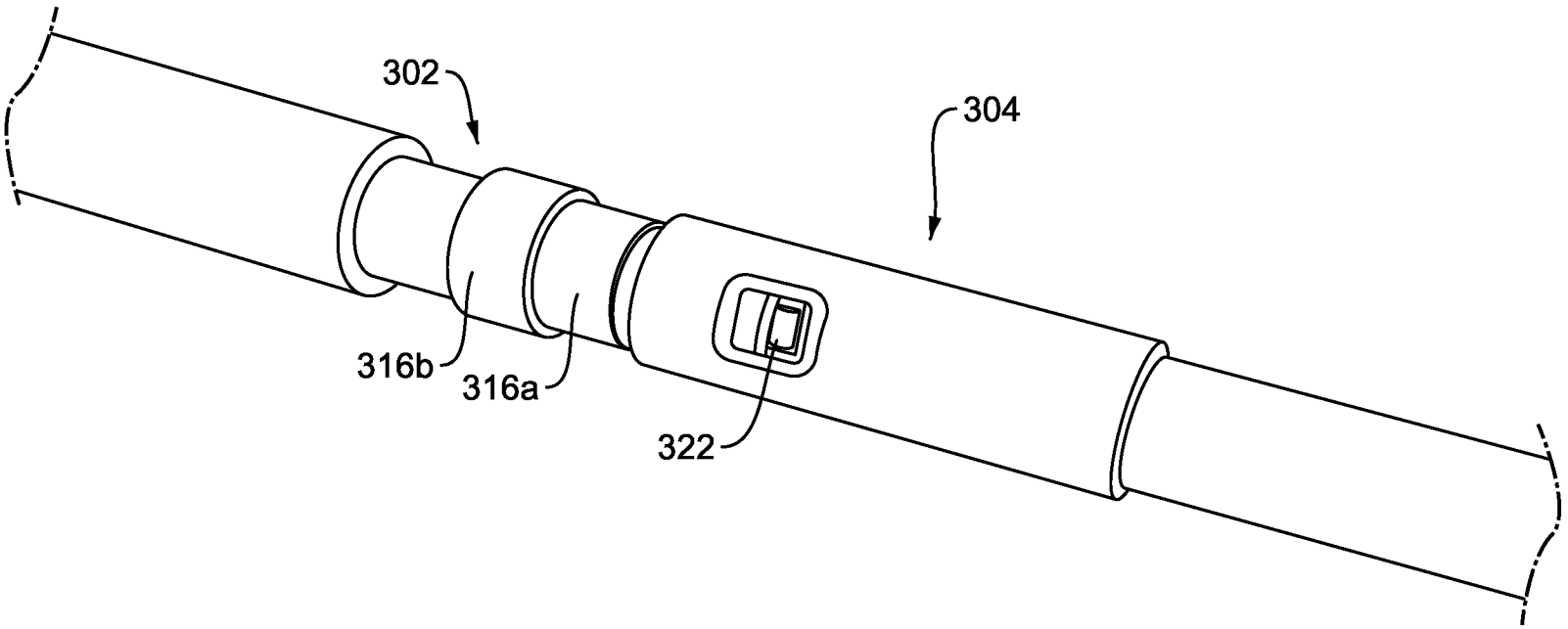

When a user clenches the spray trigger 104, cleaning liquid may be drawn out of the bottle 202. The spray trigger 104 may be pivotably mounted to the handle 116 with a proximal end where it attaches to handle 116 and a distal end on the opposite side. The trigger 104 and handle 116 may be arranged such that a user's palm can rest on the top of the handle 116 and one or more of the user's fingers can clench the trigger 104 to pivot the distal end in a direction toward the handle 116. The distal end is in contact with an internal shaft (see, e.g., FIGS. 4 and 6 below), which is disposed within the plurality of pole sections. As the distal end pivots during actuation of the trigger 104, it may depress the internal shaft to move it in a downward direction to drive a piston to open a valve of the bottle adaptor. As a result, the cleaning liquid stored in the bottle 202 is drawn out, exits the nozzle 112, and is sprayed onto the floor surface in front of the mop 100. When the user releases the spray trigger 104, the internal shaft may be moved upward by a reload spring and air enters the bottle 202 above the level of the cleaning liquid contained therein, thereby preventing the cleaning liquid from dripping from the bottle 202. Through this process, a flow path may be created in the mop 100 that may repeatedly direct cleaning liquid to flow from the bottle 202 and exit the bottle reservoir 110 through the nozzle 112 in response to each actuation of the spray trigger 104.

Figure 5:
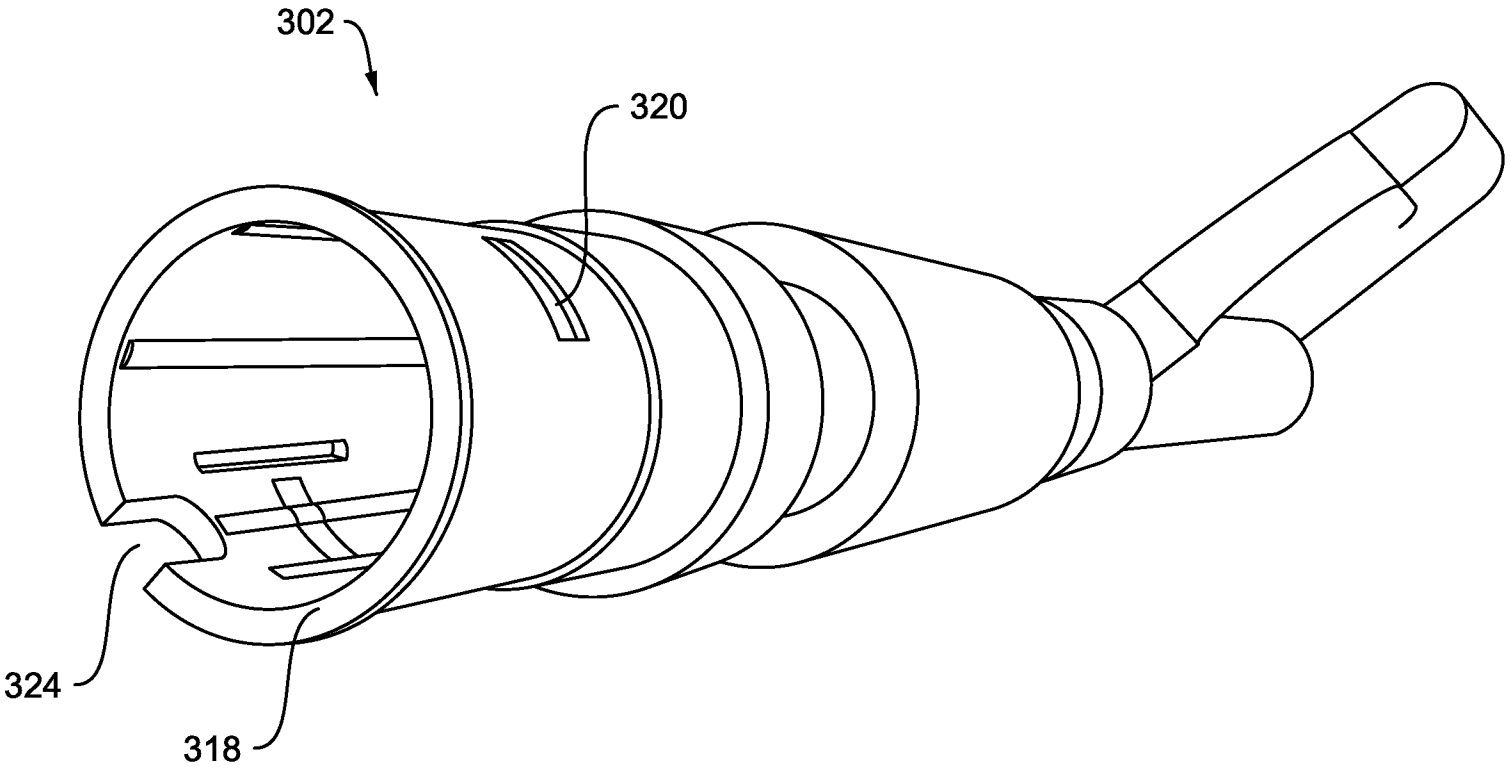

Referring now to a 3-piece detachable mop body configuration in accordance with aspects of the present disclosure, similar to certain aspects described above with respect to FIGS. 1 and 2, the upper sole pole section 302 may include an angled ergonomic mop handle 308 at one distal end for a user to guide a mop in a desired direction with reduced hand and wrist strain. A spray trigger 310, pivotably mounted to the handle 308 at a proximal end where it attaches to handle 308 and a distal end on the opposite side, may be clenched by a user during use to draw cleaning liquid out of a cleaning product stored in a bottle reservoir 312 of the lower pole section 306. The distal end of spray trigger 310 is in contact with a shaft (see FIGS. 4-6) that may be configured to movable within all the connecting pieces of mop body 300 when assembled together. As a result, when the distal end pivots during actuation of the spray trigger 310, it may drive and move a piston in a downward direction, through an internal tube of middle connecting pole section 304 which will be described fully below, to open a valve of a bottle adaptor of the cleaning product stored in the bottle reservoir 312 in order to spray the cleaning liquid. When the user releases the spray trigger 310, the shaft may be moved upward by a reload spring and air enters the bottle reservoir 312 above the level of the cleaning liquid contained therein, thereby preventing the cleaning liquid from dripping from the bottle reservoir 312. The upper pole section 302 may also include a soft support grip portion 314 on its shaft to provide a secondary handhold.

In accordance with aspects of the present disclosure, as shown in FIGS. 3 and 7-13, two connecting pole sections of a mop body, such as upper pole section 302 and middle connecting pole section 304 of multi-piece detachable mop body 300, may be configured to attach to each other with enhanced rigidity. The coupling mechanism implemented between the connecting pole sections may result in reinforced joints not subject to breaking or snapping during use of the mop. Specifically, a sleeve portion 316 may be configured to be slidable along the outer surface of the upper pole section 302 between the soft support grip portion 314 and a connecting end 318. In one embodiment, sleeve portion 316 may be an integral body with a stepped geometry—a small diameter portion 316*a* and a large diameter portion 316*b*. A slot 320, in rectangular or any suitable shape, may be implemented between the sleeve portion 316 and the connecting end 318 of the upper pole section 302 for receiving a locking member 322 of middle connecting pole section 304. A guide notch 324 may be implemented on the connecting end 318 of the upper pole section 302 to provide a visual aid for proper connection between the upper pole section 302 and middle connecting pole section 304.

Figure 12:
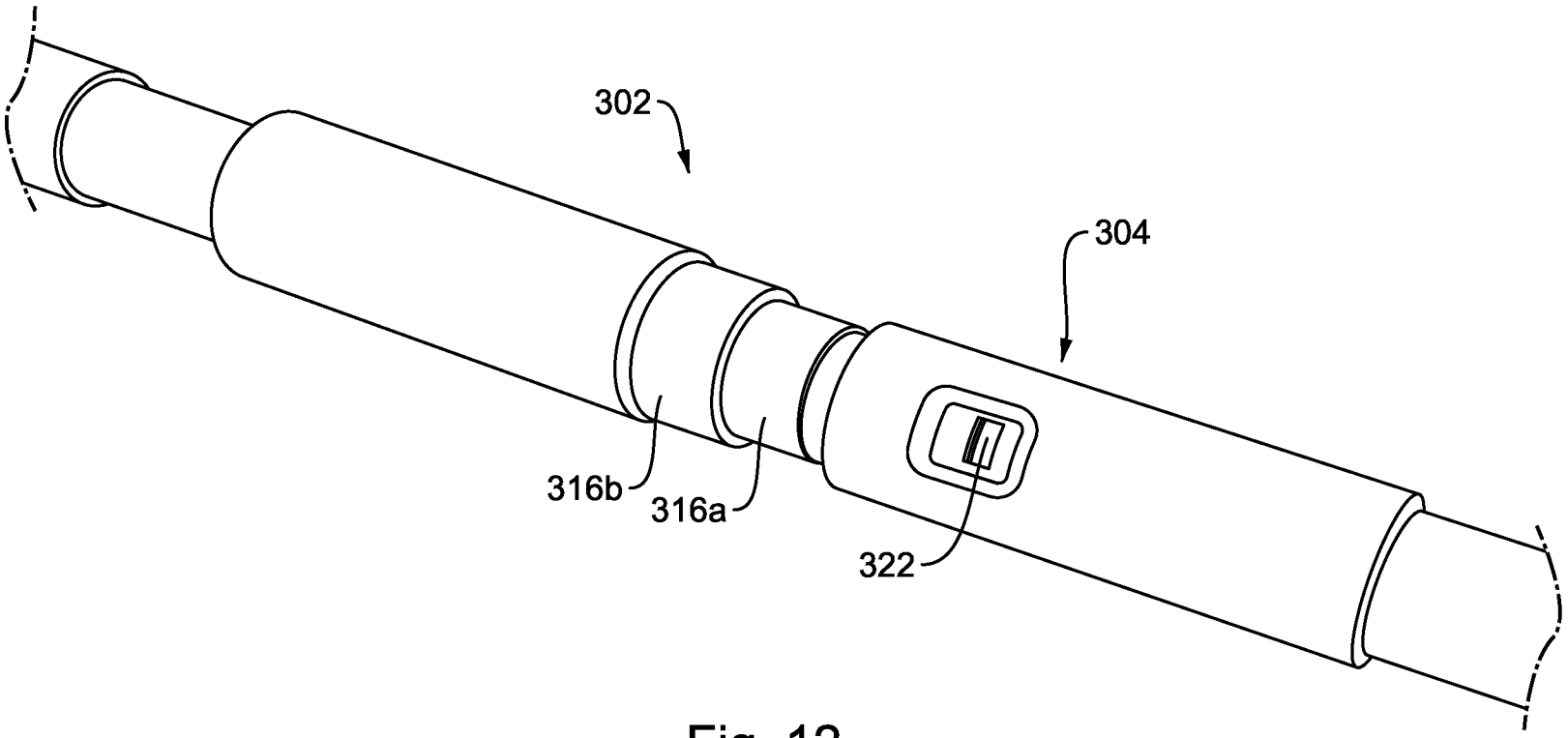
Figure 13:
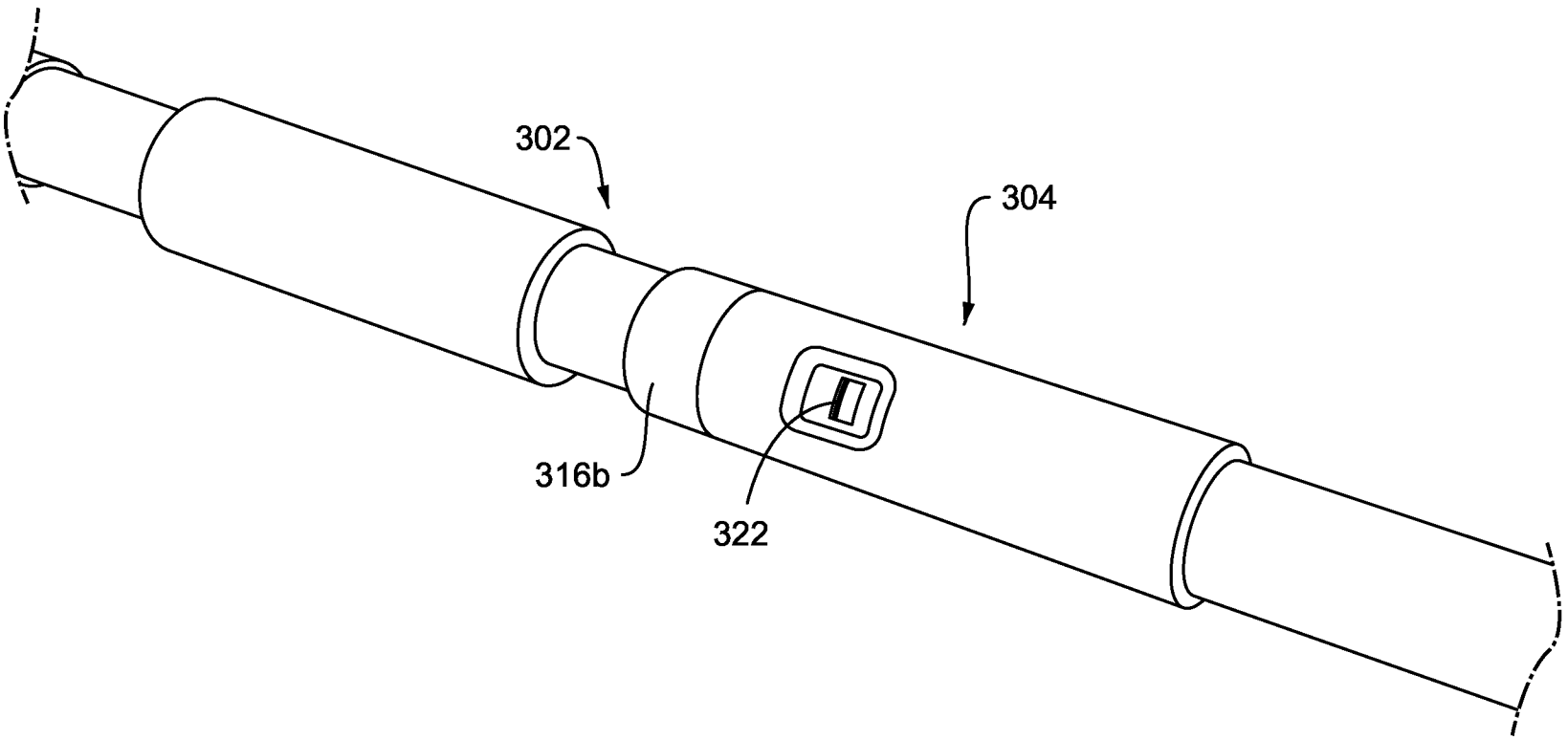
Figure 14:
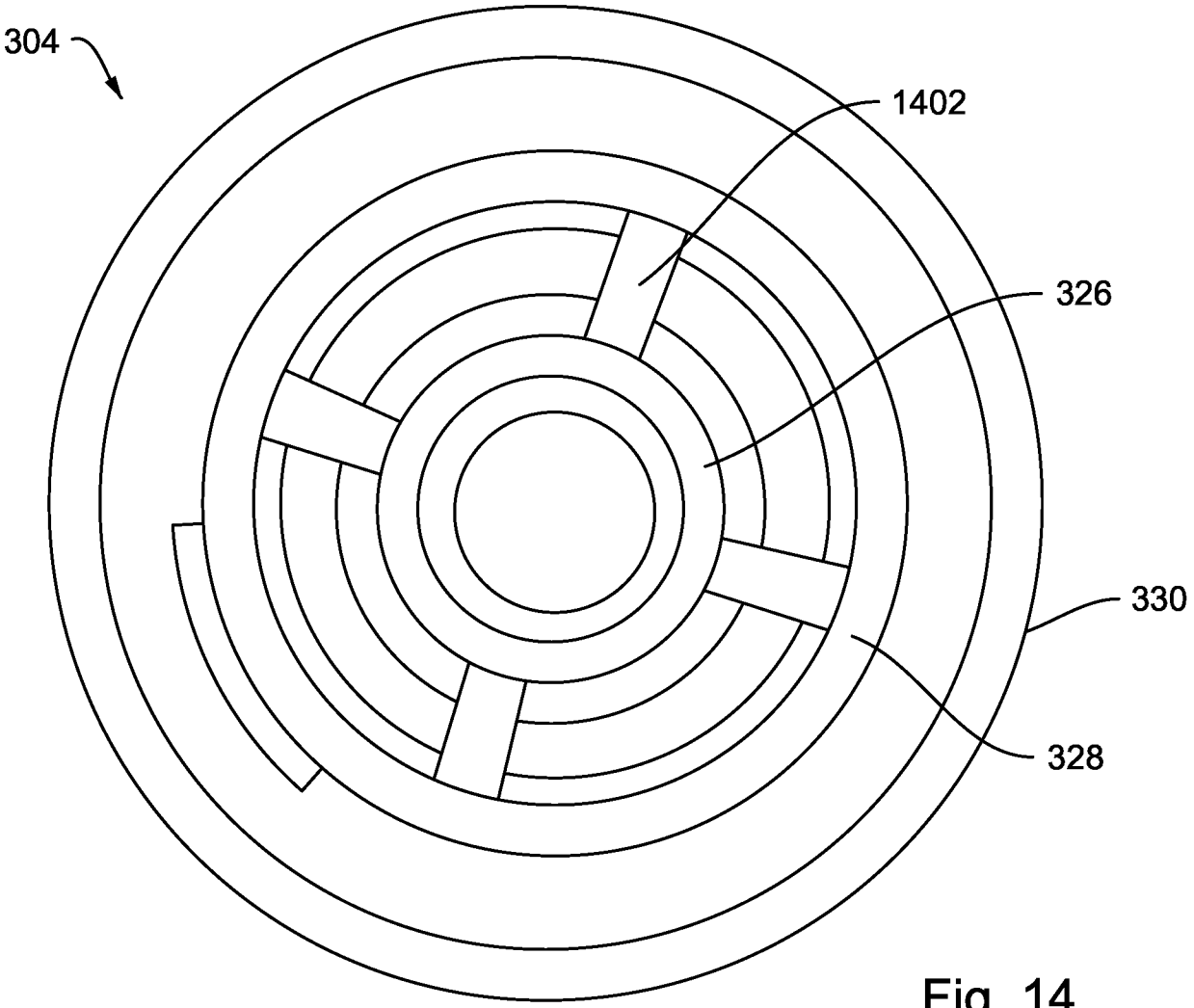
FIGS. 14-16 illustrate various end perspective views of a second pole section of the multi-piece detachable mop body, according to an exemplary aspect.
Figure 15:
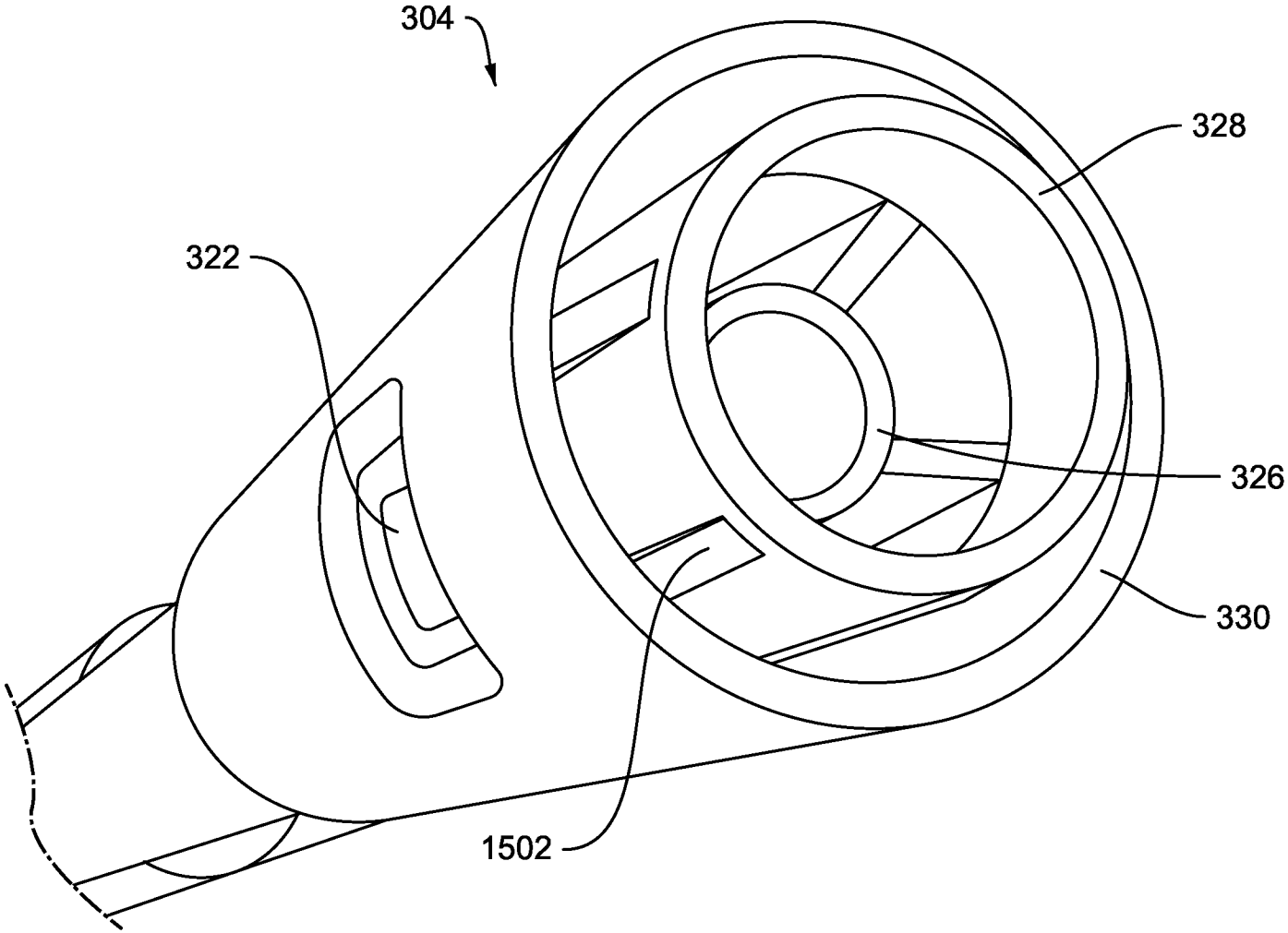
Figure 16:
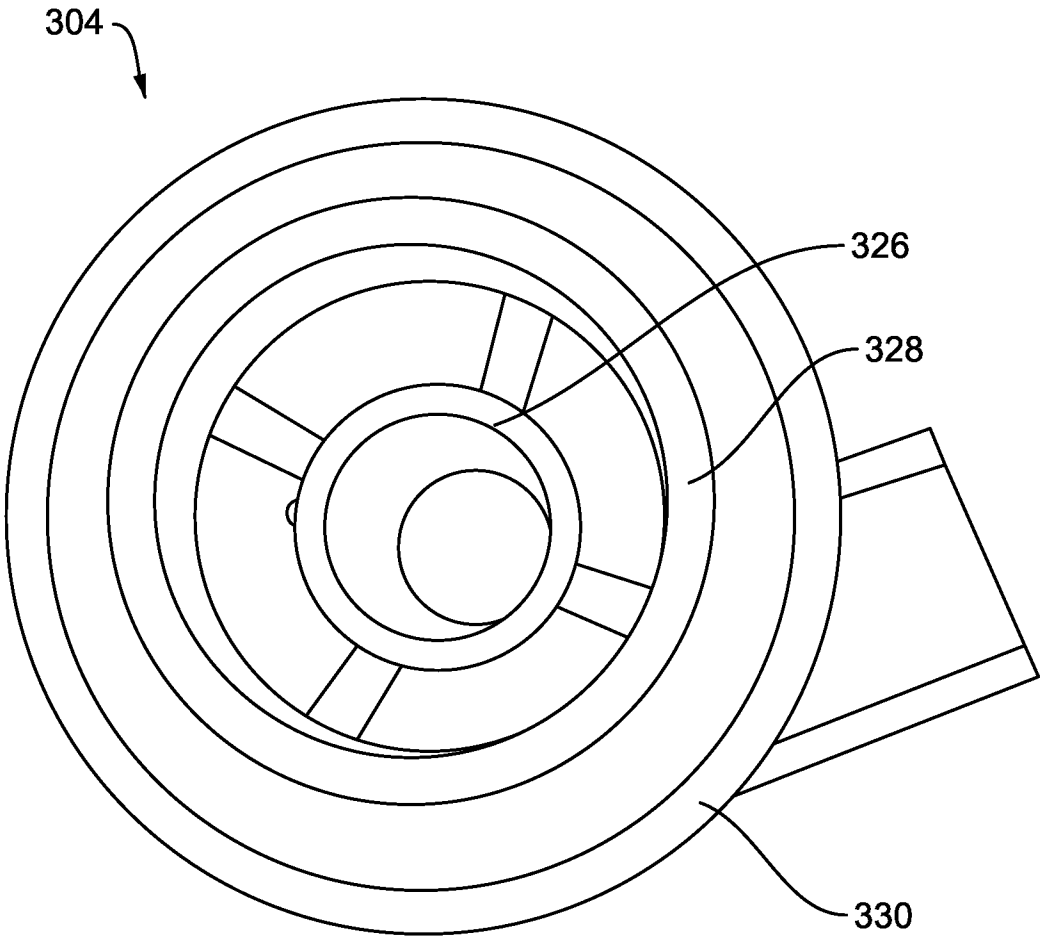

As shown in FIGS. 4 and 14-16, to establish a tight and rigid engagement with the upper pole section 302, middle connecting pole section 304 may have a connecting end having at least three concentric tubes 326, 328 and 330. The inner most tube 326 may be configured to allow the movable pumping components of the spray mop (e.g., shaft or piston) to move downward and upward when the spray trigger 310 is actuated and released. For increased structural stability and rigidity, as shown in FIG. 14, a plurality of ribs 1402 extending radially between the inner most tube 326 and middle tube 328 may be implemented. Similarly, as shown in FIG. 15, a plurality of ribs 1502 extending in a longitudinal direction along the exterior surface of the middle tube 328 may also be implemented. When assembled together, as shown in FIG. 12, a user may insert the connecting end 318 of the upper pole section 302 into the annular space defined by the middle tube 328 and the outermost tube 330 of middle connecting pole section 304, until the rectangular slot 320 properly receives and locks the locking member 322. Subsequently, as shown in FIG. 13, the small diameter portion 316*a* of stepped sleeve portion 316 may be inserted into the annular space defined by the outer surface of the upper pole section 302 and the inner surface of the outermost tube 330 of middle connecting pole section 304, until the larger diameter portion 316*b* is pushed and secured against the connecting end of middle connecting pole section 304. As a result, the upper pole section 302 and middle connecting pole section 304 forms an integral elongated body to effectively resist radial and/or circumferential movement therebetween. In one embodiment, the diameter of the large diameter portion 316*b* may be substantially equal to the diameter of the outermost tube 330, such that when the upper pole section 302 and middle connecting pole section 304 securely engages with each other via at least the small diameter portion 316*a*, both pole sections are flush with each other to achieve smooth continuous connecting surface, as shown in FIG. 13.

To disconnect two connecting pole sections (e.g., the upper pole section 302 and middle connecting pole section 304), a user may slide the small diameter portion 316*a* of stepped sleeve portion 316 out of the annular space defined by the outer surface of the upper pole section 302 and the inner surface of the outermost tube 330 of middle connecting pole section 304. Thereafter, the user may push the locking member 322 inward to disengage with the slot 320 and pull the upper pole section 302 and middle connecting pole section 304 apart from each other.

As shown in FIG. 3, the middle connecting pole section 304 and the lower pole section 306 may be connected with each other via, e.g., a lock notch 332 or other suitable means such as the coupling mechanism described above with respect to the upper pole section 302 and middle connecting pole section 304. The lower pole section 306 may also have a distal end 334 including a protruding coupling portion for connecting with, e.g., a mop base or a brush.

It should be appreciated that, although described in 3-piece configuration, the aforementioned mop body may be implemented with any number of pole sections using the disclosed coupling mechanism.

The above description of the disclosure is provided to enable a person skilled in the art to make or use the disclosure. Various modifications to the disclosure will be readily apparent to those skilled in the art, and the common principles defined herein may be applied to other variations without departing from the spirit or scope of the disclosure.

Furthermore, although elements of the described aspects and/or embodiments may be described or claimed in the singular, the plural is contemplated unless limitation to the singular is explicitly stated. Additionally, all or a portion of any aspect and/or embodiment may be utilized with all or a portion of any other aspect and/or embodiment, unless stated otherwise. Thus, the disclosure is not to be limited to the examples and designs described herein but is to be accorded the widest scope consistent with the principles and novel features disclosed herein.

The invention claimed is:

1. A multi-piece detachable mop body, comprising:

a plurality of pole sections configured to couple with one another to form an integral elongated body during use and disengage with one another into the plurality of pole sections for transportation, packaging and storage purposes, wherein a first pole section of the plurality of pole sections is configured to include a sleeve portion slidable along an outer surface of the first pole section, and a slot for receiving a locking member, wherein a second pole section of the plurality of pole sections is configured to couple with the first pole section during use, the second pole section including at least two concentric tubes to define an annular space for receiving a connecting end of the first pole section, and wherein the sleeve portion of the first pole section comprises a small diameter portion and a large diameter portion wherein the small diameter portion is slidable between an annular space defined by an outer surface of the first pole section and an inner surface of an outermost tube of the at least two concentric tubes.

2. The multi-piece detachable mop body of claim 1, wherein the second pole section comprises the locking member for fitting into the slot of the first pole section when the first and second pole sections are coupled with each other.

3. The multi-piece detachable mop body of claim 2, wherein the locking member is configured to dislodge from the slot of the first pole section when the first and second pole sections are disengaged with each other.

4. The multi-piece detachable mop body of claim 1, wherein a diameter of the large diameter portion is substantially equal to that of the outermost tube of the at least two concentric tubes.

5. A multi-piece detachable mop body, comprising:

a plurality of pole sections configured to couple with one another to form an integral elongated body during use and disengage with one another into the plurality of pole sections for transportation, packaging and storage purposes;

wherein a first pole section of the plurality of pole sections is configured to include a sleeve portion slidable along an outer surface of the first pole section, and a slot for receiving a locking member, wherein a second pole section of the plurality of pole sections is configured to couple with the first pole section during use, the second pole section including at least two concentric tubes to define an annular space for receiving a connecting end of the first pole section, wherein each of the plurality of pole sections is configured to have an internal shaft to facilitate pumping of cleaning product stored in a bottle reservoir to exit a nozzle head, and wherein the second pole section comprises a third tube that is the most inner most and concentric with the at least two concentric tubes, the third tube having the internal shaft for facilitating the pumping of cleaning product stored in the bottle reservoir to exit the nozzle head.

6. The multi-piece detachable mop body of claim 1, further comprising a plurality of radially extending ribs between an annular space between the third tube and an adjacent concentric tube.

* * * * *